United States Patent [19]

Dukic

[11] 4,058,060

[45] Nov. 15, 1977

[54] GRAVITY-DEPLOYED MUNITION WITH A MECHANICAL GRAVITY-CONTROLLED SWITCH

[75] Inventor: Ferdinando V. Dukic, Lake Hopatcong, N.J.

[73] Assignee: The United States of America as represented by the Secretary of the Army, Washington, D.C.

[21] Appl. No.: 627,175

[22] Filed: Oct. 30, 1975

[51] Int. Cl.[2] ..... F42B 21/00; F42C 9/00

[52] U.S. Cl. ..... 102/8; 102/72

[58] Field of Search ..... 102/8, 19.2, 24 HC, 102/56 SC, 70.2 R, 72; 200/225, 233, 235, 240, 241

[56] References Cited

U.S. PATENT DOCUMENTS

| | | | |
|---|---|---|---|
| 2,411,788 | 11/1946 | Hammond | 102/70.2 R |
| 2,706,949 | 4/1955 | Kessenich | 102/24 HC |
| 2,863,014 | 12/1958 | Deer | 200/225 |
| 3,086,468 | 4/1963 | Mountjoy | 102/70.2 R |
| 3,088,014 | 4/1963 | Stewart | 200/225 |
| 3,158,705 | 11/1964 | Bliss | 102/70.2 R |
| 3,292,536 | 12/1966 | Church | 102/24 HC |
| 3,495,532 | 2/1970 | Roberts | 102/24 HC |
| 3,557,697 | 1/1971 | Joyner | 102/2 |
| 3,875,862 | 4/1975 | Fischer | 102/56SC |
| 3,956,988 | 5/1976 | Pecksen | 102/24 HC |

FOREIGN PATENT DOCUMENTS

| | | | |
|---|---|---|---|
| 2,067,683 | 10/1969 | France | 102/56 SC |
| 2,071,271 | 9/1971 | France | 102/8 |
| 14,928 of | 1892 | United Kingdom | 200/226 |

*Primary Examiner*—Verlin R. Pendegrass
*Assistant Examiner*—Donald P. Walsh
*Attorney, Agent, or Firm*—Nathan Edelberg; Thomas R. Webb; A. Victor Erkkila

[57] ABSTRACT

A land mine adapted to be deployed by gravity and comprising: a housing having a hollow cylindrical side wall and two end walls, on either of which the mine may come to rest. A main explosive charge in the housing, a clearing charge located between the main charge and each end wall; explosive firing means; a mechanical gravity-controlled switch including a body formed with a cavity having two spaced outlet passages and an intermediate inlet passage, and a weight movable in the cavity; a firing train connecting each of the outlet passages to one of the clearing charges; and a firing train connecting the firing means to the inlet passage; the weight being movable by gravity when the mine comes to rest to a position wherein the firing train connected to the upper clearing charge is exposed to, and the firing train connected to the lower clearing charge is isolated from, the firing means.

4 Claims, 7 Drawing Figures

GRAVITY-DEPLOYED MUNITION WITH A MECHANICAL GRAVITY-CONTROLLED SWITCH

GOVERNMENTAL INTEREST

The invention described herein may be manufactured, used and licensed by or for the Government for Governmental Purposes without the payment to me of any royalties thereon.

BACKGROUND AND SUMMARY OF THE INVENTION

The present invention relates to an improved explosive mine for anti-tank or anti-personnel use. Such mines are placed on or under the ground in areas occupied by enemy tanks or troops, and are provided with some means whereby the explosive charge of the mine is initiated by the presence of the enemy, such as a proximity fuse. One method used to distribute or place mines in such areas is to assemble a plurality of mines in an artillery or howitzer projectile launch the projectile toward the desired area, and eject the mines from the projectile in air, to be deployed by gravity to the ground. Each mine normally has two opposite relatively flat ends, on either of which the mine can come to rest.

It has been suggested that a gravity-deployed land mine be provided with an explosive clearing charge on each side of the mine, in addition to the main explosive charge within the mine, and fuze means for initiating the upper clearing charge only, in response to a firing signal. This fuze means includes a gravity-controlled mercury switch responsive to the firing signal to select the clearing charge that is uppermost.

An object of the present invention is to provide an improved, mechanical, gravity switch, in lieu of the mercury switch, in the gravity-deployed land mine suggested.

In accordance with the invention, a gravity-deployed munition, adapted to come to rest on either end, is provided with a separate explosive charge at each end, a mechanical, gravity-controlled switch having a cavity with two spaced outlet passages and an intermediate inlet passage and a weight in the cavity, a separate firing train connecting each outlet passage with one of the charges, and firing means connected to the inlet passage, with the weight being movable in the cavity, when the munition comes to rest on one side, to a position wherein the firing train connected to the upper charge is exposed to, and the firing train connected to the lower charge is isolated from, the firing means.

In the embodiment illustrated as an example, the munition is a land mine having a housing including end walls attached to a side wall and containing a high explosive main charge, and each of the other charges is disposed between the main charge and one of the end walls, whereby the initiation of the upper charge removes the adjacent upper end wall from the housing and exposes the main charge.

DETAILED DESCRIPTION OF THREE EMBODIMENTS OF THE INVENTION

Figure 1:
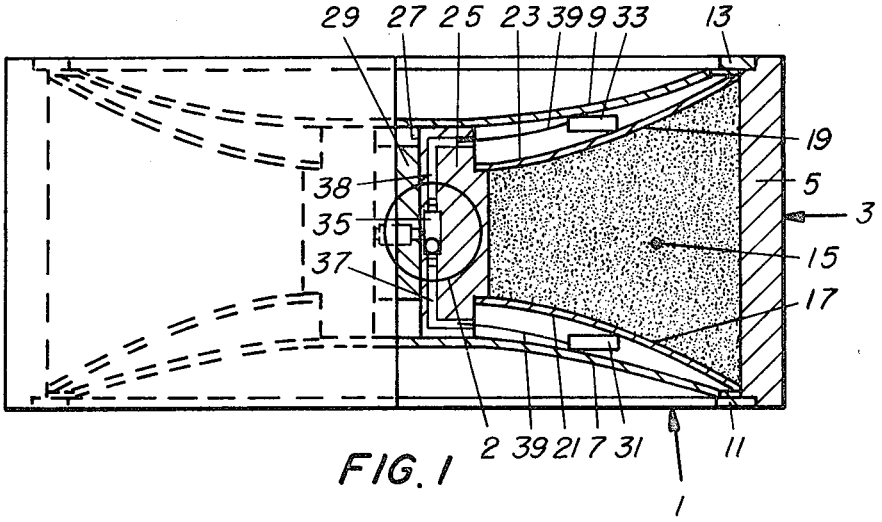
FIG. 1 is a side elevation view, partly in axial section, of a relatively short cylindrical mine including a preferred embodiment of the present invention.

FIG. 1 shows an explosive land mine 1 of cylindrical form comprising an external housing 3 made up of a short cylindrical wall 5 and two end walls 7 and 9 held in place by two retaining rings 11 and 13. Mounted within the housing 3 is an annular charge 15 of high explosive material, e.g. pressed PBX, which may have concave opposite ends 17 and 19, lined with thin metal liners 21 and 23, to form a double-ended Misznay-Schardin, or plate, charge. Mounted in the central opening of the annular charge 15 is a generally-cylindrical fuze body 25 having an axial bore 27 containing a slider 29 which may form part of a SAFE-AND-ARM and firing means disclosed and claimed in a copending application of Norman Regber, Frank Diorio and me, Ser. No. 627,176 filed concurrently herewith, with the same assignee.

The mine 1 is deployed by gravity and comes to rest on either of its opposite ends. The mine 1 is provided with a clearing charge comprising a low explosive propellant at each end thereof, between the end wall 7 or 9 and the main charge 15, as shown at 31 and 33.

Figure 2:
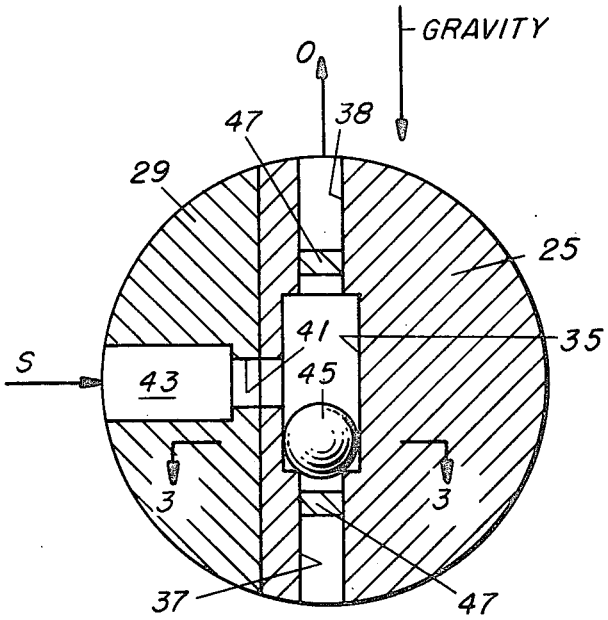
FIG. 2 is an enlargement of the circular area 2 in FIG. 1.
Figure 3:
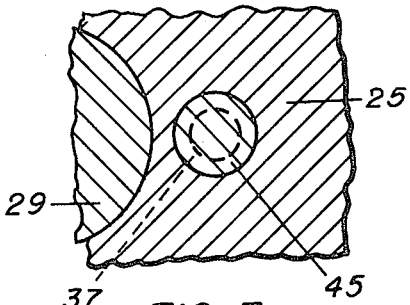
FIG. 3 is a section view taken on the line 33 of FIG. 2.

As shown in FIGS. 1–3, the fuze body 25 is formed with an elongated cylindrical cavity 35 oriented parallel to the central axis of the body 25 and mine 1, so that it will be vertically oriented when the mine rests on one end. The fuze body 25 is also formed with two outlet passages or ducts 37 and 38, having a diameter smaller than the cavity 35, extending from the ends of cavity 35 to the space between each liner 21 or 23 and the adjacent end wall 7 or 9. A length of primacord 39, or other combustible cord, extends from each clearing charge 31 or 33 into each passage 37 or 38, to complete a firing train from the cavity 35 to each clearing charge 31 or 33. Cavity 35 is coupled to the bore 27 by an intermediate passage 41 formed in body 25. When the slider 29 is in its armed position, as shown in FIGS. 1–3, passage 41 is aligned with a transverse explosive lead 43 in the slider 39. A gravity-controlled switch is completed by a spherical weight 45, having a diameter slightly less than that of cavity 35 but greater than the passages 37 and 39, slidable by gravity in the cavity 35, when the mine comes to rest, to the lower end of the cavity to block the lower passage 37 or 39 while exposing the upper passage to the explosive firing lead 43. Preferably, an acceptor cup, or other combustible device, 47 may be mounted in each outlet passage 37 and 39, to assist in propagating an explosive wave from the lead 43 to the clearing charge 31 or 33.

When the mine 1 is deployed and comes to rest on one of its ends, the weight 45 automatically falls by gravity and exposes the firing train leading to the upper clearing charge, as indicated by the output arrow 0 in FIG. 2. At any time thereafter, the explosive lead 43 may be initiated by a signal S, such as a proximity fuze triggered by the presence of an enemy tank or person, to initiate the upper clearing charge 31 or 33, by means of the gravity-controlled switch. This results in the removal of the adjacent upper wall 7 or 9 from the housing 3 and exposure of the main charge 15.

Figure 4:
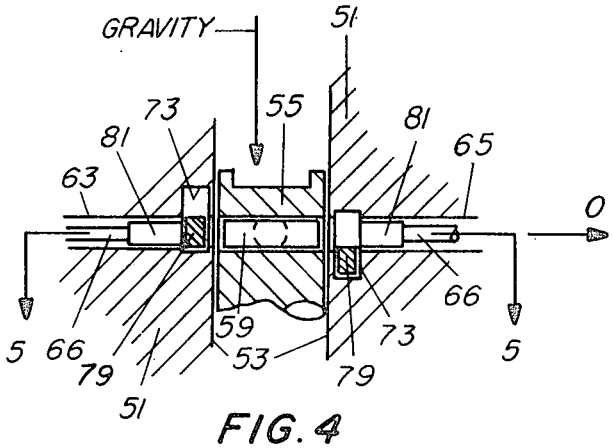
FIG. 4 is a section view, similar to FIG. 2, showing a first modification.
Figure 5:
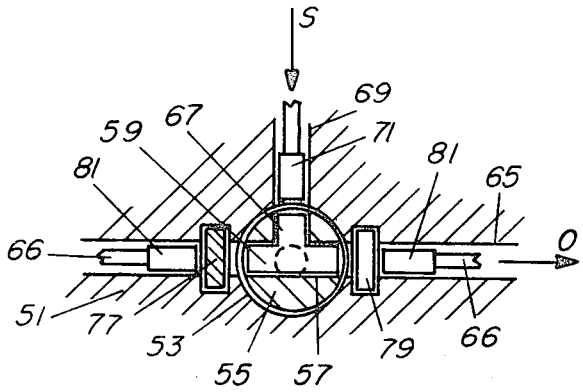
FIG. 5 is a section view taken on line 5—5 of FIG. 4.

FIGS. 4 and 5 show an alternative embodiment or modification involving two gravity-controlled weights instead of one. The fuze body 51 has an axial bore 53 containing a slider 55 corresponding to the vertically-movable slider 29 of FIGS. 1–3. The slider 55 has a T-shaped explosive firing lead 59. When the slider 55 is in the armed position shown in FIGS. 4 and 5, the head of 61 of the T is aligned with two outlet passages or ducts 63 and 65 in fuze body 51, which are connected to the two clearing charges (not shown) by combustible cords 66 as in FIG. 1. The vertical portion 67 of the T is aligned with an inlet passage 69 containing a detonator or other initiator 71 for initiating the lead 59 in response to a firing signal. The fuze body 51 is further formed with two slots 73 and 75, extending across the passages 63 and 65 in opposite directions as shown in FIG. 4, and containing two slidable weights 77 and 79. In the position shown in FIG. 4, the weights 77 and 79 are in their lowest position, with weight 77 blocking the outlet passage 63 and the weight 79 exposing the other outlet passage 65 to the lead 59, as indicated by the output arrow 0. When the mine falls on the opposite end, the weights are reversed, thus exposing passage 63 and blocking passage 65. An acceptor cup, or other combustible device 81 may be mounted in each outlet passage 63 and 65 as in FIGS. 1–3.

Figure 6:
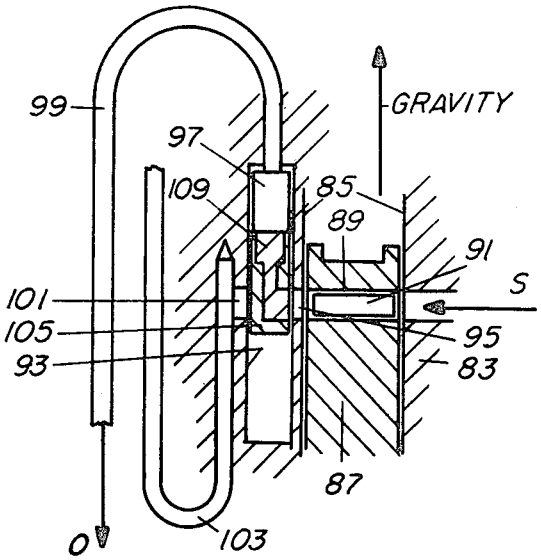
FIGS. 6 and 7 are section views similar to FIG. 2, showing a second modification with the switch slider in its two different positions.
Figure 7:
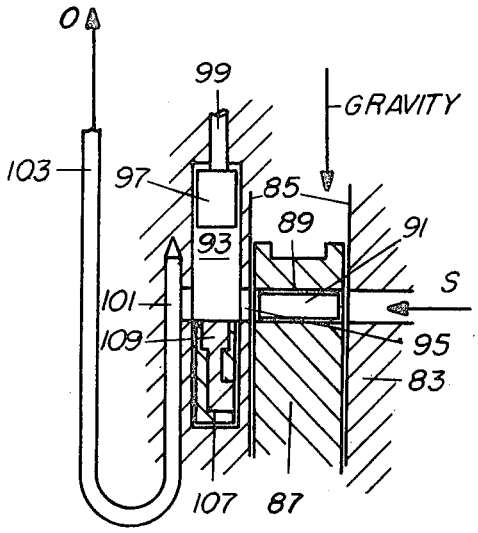

FIGS. 6 and 7 shown another alternative embodiment using a single weight. The fuze body 83 has an axial bore 85 containing a slider 87 corresponding to the vertically-movable slider 29 in FIGS. 1–3. Slider 87 has a transverse opening 89 containing an explosive firing lead 91. Fuze body 83 is formed with an elongated opening 93, parallel to bore 85 and spaced therefrom, and a flash passage 95 connecting bore 85 and opening 93 and aligned with lead 91 when the slider 87 is in its armed position. A detonator 97 is mounted in the upper end of opening 93, as shown in FIGS. 6 and 7,and connected by a combustible cord 99 to the clearing charge (not shown) at the opposite end of the mine. A flash passage 101 in fuze body 83, is aligned with passage 95, is connected by a combustible cord 103 to the other clearing charge (not shown). A weight 105, mounted for rectilinear movement in opening 93, has an L-shaped opening 107 containing an L-shaped explosive lead 109. In the position shown in FIG. 6, with the force of gravity in the direction shown by the arrow, the weight 105 rests on the detonator 97, exposes the lead 109 to the lead 91, and blocks the flash passage 101 connected to the lower clearing charge. Explosion of lead 91 by a suitable signal S initiates explosive lead 109 which in turn, initiates detonator 97 to explode the upper clearing charge, as indicated by the output arrow 0. In the position of FIG. 7, weight 105 is at the other end of opening 93 where it exposes both the flash passage 101 and the detonator 97 to the lead 91. However, the detonator 97 is incapable of being initiated by the explosion of lead 91 alone, and hence, the lower clearing charge connected thereto is effectively isolated from the input signal, while the upper clearing charge connected to flash passage 101 is initiated by combustion of cord 103, as indicated by the output arrow 0.

A copending application of Allen E. Stern, Ser. No. 627,174 filed concurrently herewith, discloses and claims a double-ended mine similar to that disclosed herein, alone, and in combination with a clearing charge at each end and gravity-controlled means for initiating the upper clearing charge only.

What is claimed is:

1. In a land mine comprising a housing having two opposite external ends and adapted to be deployed and come to rest by gravity on either of said ends; said mine further comprising a separate explosive charge at each of said ends, and fuze means in said housing for selectively initiating the upper charge only, in response to a firing signal; said fuze means comprising:

a gravity-controlled mechanical switch including a body formed with an elongated cavity oriented transverse to said ends and having two spaced outlet passages and an intermediate inlet passage, and a solid weight slidable in said elongated cavity;

a separate firing train connecting each of said outlet passages to one of said charges; and firing means connected to said inlet passage for applying an explosive signal wave to said switch;

said weight being slidable along said cavity by gravity, when said mine comes to rest, to a position wherein the firing train connected to the upper charge is exposed to said firing means and the firing means and the firing train connected to the lower charge is effectively isolated by said weight from said firing means.

2. Fuze means as in claim 1, wherein said cavity is cylindrical, and said weight is a spherical ball slidable by gravity in said cavity to said position.

3. Fuze means as in claim 2, wherein said outlet passages are axial openings of smaller diameter than said cylindrical cavity, and said spherical ball has a diameter intermediate the diameters of said openings and said cavity.

4. Fuze means as in claim 1, wherein said housing comprises two end walls attached to the ends of a hollow connecting side wall, and a high explosive main charge is mounted in said housing; the first named charges being disposed between said end walls, and said main charge, whereby initiation of said upper charge removes the adjacent upper end wall from said housing and exposes said main charge.

* * * * *